US005566859A

United States Patent [19]

Willis et al.

[11] Patent Number: 5,566,859

[45] Date of Patent: Oct. 22, 1996

[54] FOIL PIERCING AND CLEARING NOZZLE

[76] Inventors: Charles M. Willis; William V. Willis, both of 13534 Claudia Dr., Hudson, Fla. 34667

[21] Appl. No.: 364,542

[22] Filed: Dec. 27, 1994

Related U.S. Application Data

[63] Continuation-in-part of Ser. No. 21,313, Apr. 13, 1994, abandoned, which is a continuation of Ser. No. 762,946, Sep. 19, 1991, abandoned.

[51] Int. Cl.[6] ..... B67D 5/00

[52] U.S. Cl. ..... 222/83.5; 222/88; 222/90; 222/153.06; 222/541.2

[58] Field of Search ..... 222/80, 81, 83, 222/83.5, 88, 90, 153.6, 541.2

[56] References Cited

U.S. PATENT DOCUMENTS

| | | | |
|---|---|---|---|
| 3,106,318 | 10/1963 | Cook | 222/90 |
| 3,613,955 | 10/1971 | Wetherell, Jr. | 222/541.2 X |
| 4,322,018 | 3/1982 | Rutter | 222/83 |
| 4,553,971 | 11/1985 | Ashley et al. | 604/415 |
| 4,723,687 | 2/1988 | Kutterer | 222/541.2 X |
| 4,759,472 | 7/1988 | Strenger | 222/92 |
| 4,790,453 | 12/1988 | Fontana et al. | 222/83 |
| 4,901,890 | 2/1990 | Mivelaz | 222/395 |
| 4,938,390 | 7/1990 | Markva | 222/206 |
| 5,072,762 | 12/1991 | Jimenez | 222/83 X |

FOREIGN PATENT DOCUMENTS

| | | | |
|---|---|---|---|
| 2004655 | 1/1990 | Japan | 222/541.2 |

*Primary Examiner*—Joseph Kaufman

[57] ABSTRACT

A foil piercing and clearing nozzle for piercing a frangible foil seal of a container and clearing the pierced seal from a flow path of the container. The inventive device includes a cylindrical main body positionable over a neck of a container. A piercing assembly is mounted within the cylindrical main body and is positioned to pierce a frangible foil seal extending across the neck of the container. A clearing assembly is concentrically mounted within the cylindrical main body and operates to clear the pierced frangible seal from a path of fluid exiting the container through the neck thereof.

5 Claims, 4 Drawing Sheets

FIG. 1
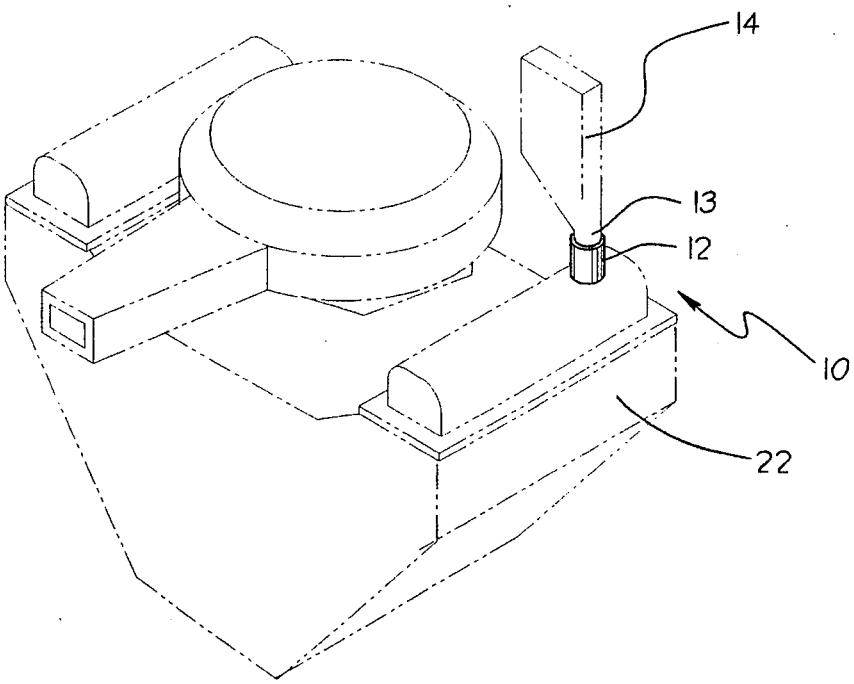
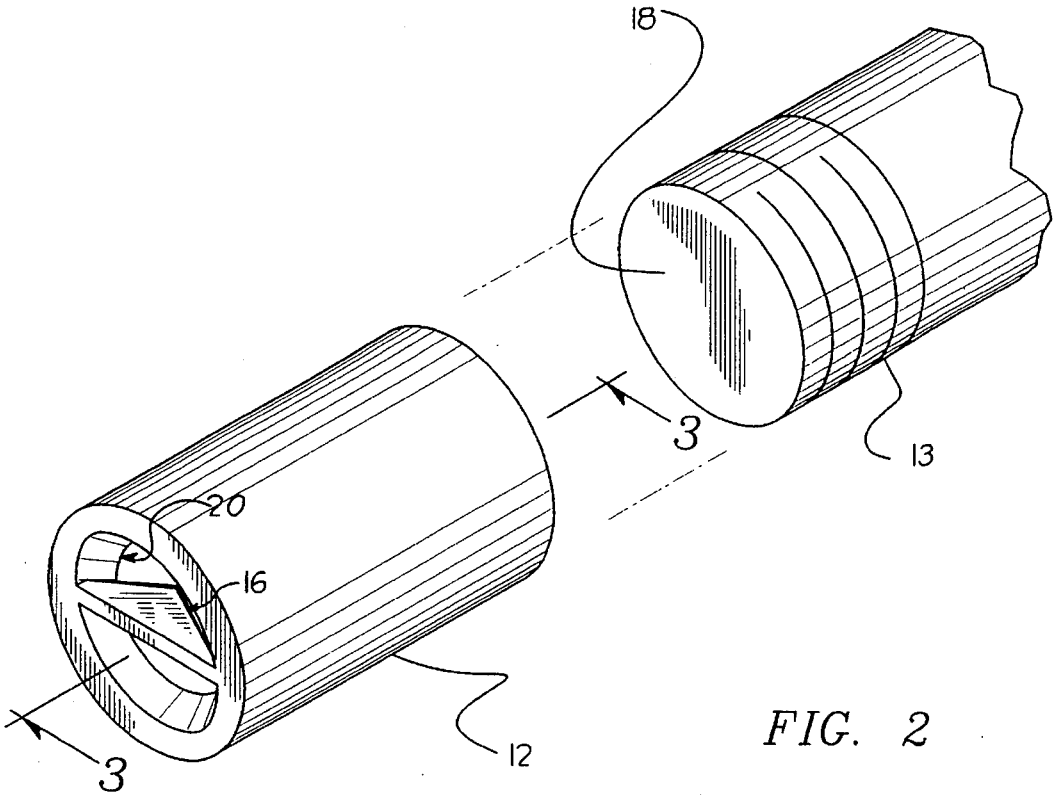
FIG. 2

FOIL PIERCING AND CLEARING NOZZLE

RELATED APPLICATIONS

This application is a continuation-in-part of application Ser. No. 29/021,313, filed Apr. 13, 1994 now abandoned, which, in turn, is a continuation of prior application Ser. No. 07/762,946, filed Sep. 19, 1991, now abandoned.

BACKGROUND OF THE INVENTION

1. Field of the Invention

The present invention relates to container opening devices and more particularly pertains to a foil piercing and clearing nozzle for piercing a frangible foil seal of a container and clearing the pierced seal from a flow path of the container.

2. Description of the Prior Art

The use of container opening devices is known in the prior art. More specifically, container opening devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art container opening devices include U.S. Pat. Nos. 2,771,218; 4,614,437; 3,261,505; 2,774,432; 2,773,722; 3,402,855; 3,731,844; 4,340,147; 4,759,472; 4,938,390; 4,901,890; 4,790,453; and 4,553,971.

While these devices fulfill their respective, particular objectives and requirements, the aforementioned patents do not disclose a foil piercing and clearing nozzle for piercing a frangible foil seal of a container and clearing the pierced seal from a flow path of the container which includes a cylindrical main body positionable over a neck of a container, a piercing assembly mounted within the cylindrical main body and positioned to pierce a frangible foil seal extending across the neck of the container, and a clearing assembly concentrically mounted within the cylindrical main body for clearing the pierced frangible seal from a path of fluid exiting the container through the neck thereof.

In these respects, the foil piercing and clearing nozzle according to the present invention substantially departs from the conventional concepts and designs of the prior art, and in so doing provides an apparatus primarily developed for the purpose of piercing a frangible foil seal of a container and clearing the pierced seal from a flow path of the container.

SUMMARY OF THE INVENTION

In view of the foregoing disadvantages inherent in the known types of container opening devices now present in the prior art, the present invention provides a new foil piercing and clearing nozzle construction wherein the same can be utilized for piercing a frangible foil seal of a container and clearing the pierced seal from a flow path of the container. As such, the general purpose of the present invention, which will be described subsequently in greater detail, is to provide a new foil piercing and clearing nozzle apparatus and method which has many of the advantages of the container opening devices mentioned heretofore and many novel features that result in a foil piercing and clearing nozzle which is not anticipated, rendered obvious, suggested, or even implied by any of the prior art container opening devices, either alone or in any combination thereof.

To attain this, the present invention generally comprises a foil piercing and clearing nozzle for piercing a frangible foil seal of a container and clearing the pierced seal from a flow path of the container. The inventive device includes a cylindrical main body positionable over a neck of a container. A piercing assembly is mounted within the cylindrical main body and is positioned to pierce a frangible foil seal extending across the neck of the container. A clearing assembly is concentrically mounted within the cylindrical main body and operates to clear the pierced frangible seal from a path of fluid exiting the container through the neck thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foil piercing and clearing nozzle apparatus and method which has many of the advantages of the container opening devices mentioned heretofore and many novel features that result in a foil piercing and clearing nozzle which is not anticipated, rendered obvious, suggested, or even implied by any of the prior art container opening devices, either alone or in any combination thereof.

It is another object of the present invention to provide a new foil piercing and clearing nozzle which may be easily and efficiently manufactured and marketed.

It is a further object of the present invention to provide a new foil piercing and clearing nozzle which is of a durable and reliable construction.

An even further object of the present invention is to provide a new foil piercing and clearing nozzle which is susceptible of a low cost of manufacture with regard to both materials and labor, and which accordingly is then susceptible of low prices of sale to the consuming public, thereby making such foil piercing and clearing nozzles economically available to the buying public.

Still yet another object of the present invention is to provide a new foil piercing and clearing nozzle which provides in the apparatuses and methods of the prior art some of the advantages thereof, while simultaneously overcoming some of the disadvantages normally associated therewith.

Still another object of the present invention is to provide a new foil piercing and clearing nozzle for piercing a frangible foil seal of a container and clearing the pierced seal from a flow path of the container.

Yet another object of the present invention is to provide a new foil piercing and clearing nozzle which includes a cylindrical main body positionable over a neck of a container, a piercing assembly mounted within the cylindrical main body and positioned to pierce a frangible foil seal extending across the neck of the container, and a clearing assembly concentrically mounted within the cylindrical main body for clearing the pierced frangible seal from a path of fluid exiting the container through the neck thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a foil piercing and clearing nozzle according to the present invention in use.

FIG. 2 is an enlarged exploded isometric illustration of the present invention.

DESCRIPTION OF THE PREFERRED EMBODIMENT

Figure 3:
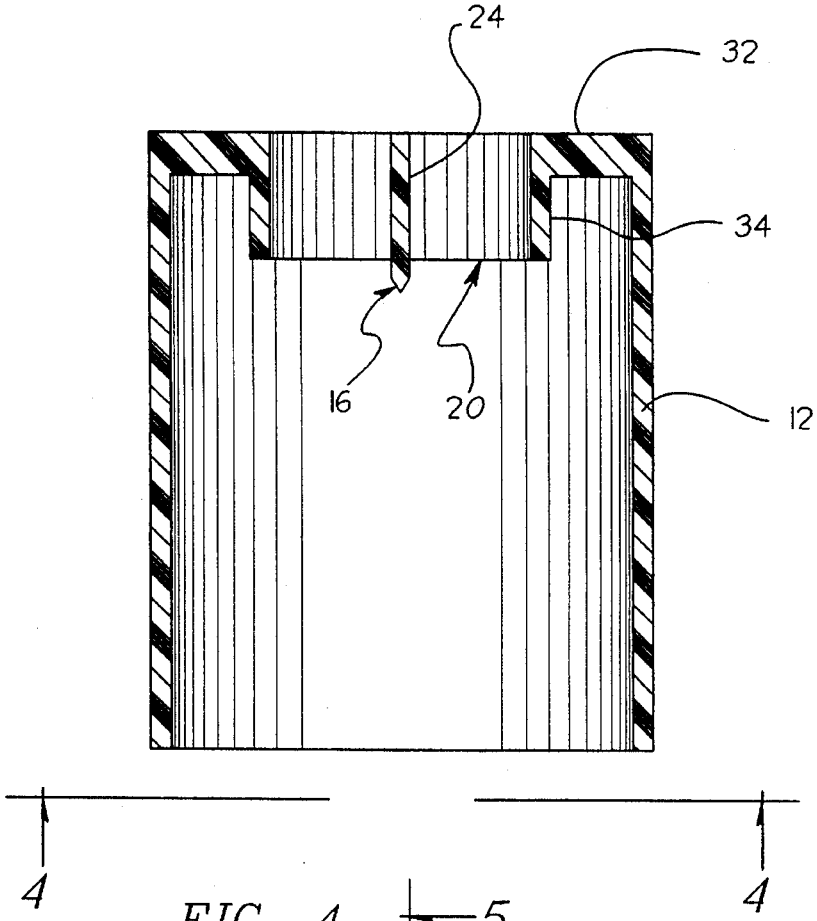
FIG. 3 is a cross sectional view taken along line 3—3 of FIG. 2.

With reference now to the drawings, and in particular to FIGS. 1–8 thereof, a new foil piercing and clearing nozzle embodying the principles and concepts of the present invention and generally designated by the reference numeral 10 will be described.

More specifically, it will be noted that the foil piercing and clearing nozzle 10 comprises a cylindrical main body 12 for positioning over a neck 13 of a container 14, such as the oil bottle illustrated in FIGS. 1 and 2 of the drawings. A piercing means 16 is mounted within the cylindrical main body 12 for piercing a frangible seal 18 extending across an end of the neck 13 of the container 14. A clearing means 20 is mounted within the cylindrical main body 12 for engaging and positioning the frangible seal into an abutting relationship with an interior surface of the neck 13 of the container 14 so as to clear the frangible seal from a path of fluid exiting from the container. By this structure, the foil piercing and clearing nozzle 10 can be positioned over the neck 13 of an oil bottle 14, with the nozzle and the container 10 being positioned in an inverted orientation over an oil fill hole of an engine 22 with the cylindrical main body 12 being positioned against a portion of the engine. The neck 13 of the container 14 can then be advanced into cylindrical main body 12 such that the piercing means 16 ruptures the frangible seal 18 of the neck. The clearing means 20 will then bias the frangible seal 18 against an interior surface of the neck 13 to permit oil from the container to be dispensed into the engine 22.

Figure 4:
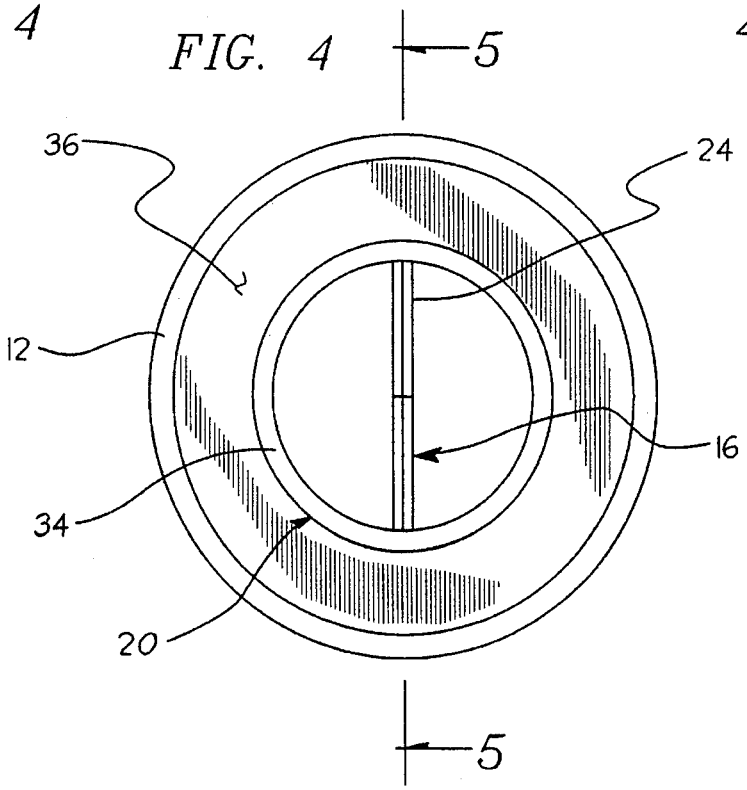
FIG. 4 is a bottom plan view of the invention.
Figure 5:
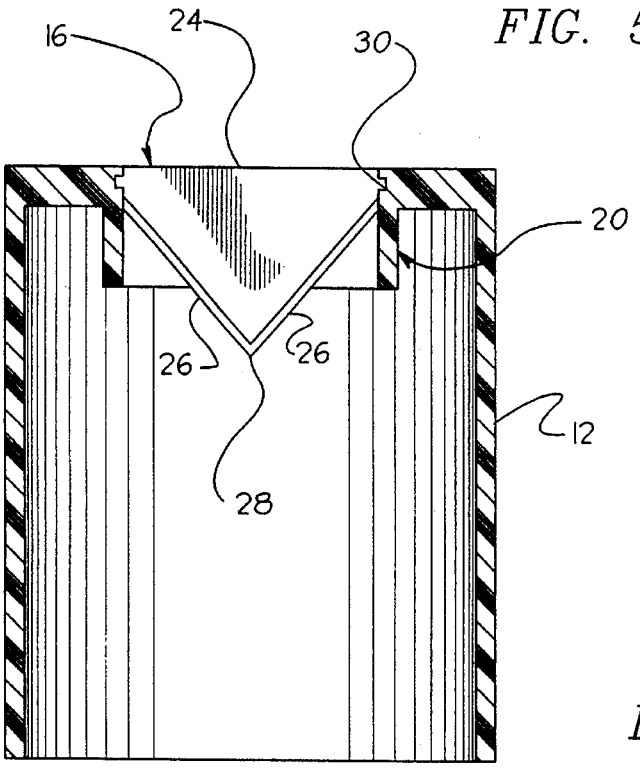
FIG. 5 is a cross sectional view taken along line 5—5 of FIG. 4.

As illustrated in FIGS. 3 through 5, it can be shown that the piercing means according to the present invention 10 comprises a piercing blade 24 coupled to diametrically opposed interior surfaces of the clearing means 20. The piercing blade 24, as shown in FIG. 5, is substantially triangular in shape and includes a pair of angled blade edges 26 extending at oblique angles relative to one another which cooperate to define a sharpened piercing tip 28. The piercing blade 24 further includes opposed mounting projections 30 which engage cooperatively formed mounting apertures within the clearing means 20. The blade 24 can thus be positioned into engagement with a frangible seal 18 of a container 14 to effect piercing rupturing of the seal.

With continuing reference to FIGS. 3 through 5, it can be shown that the clearing means 20 according to the present invention 10 preferably comprises an annular top wall 32 coupled to an end of the cylindrical main body and extending radially inwardly therefrom to terminate in an inner circumferential edge. A depending cylindrical flange 34 extends substantially orthogonally from the inner circumferential edge of the annular top wall 32 so as to be positioned in a substantially spaced and parallel orientation relative to an interior wall of the cylindrical main body. The depending cylindrical flange 34 cooperates with the interior wall of the cylindrical main body to define an annular groove 36 within which the end of the neck 13 across which the frangible seal 18 extends can be received. By this structure, the depending cylindrical flange 34 can engage the frangible seal 18 and bias the same out of a path of flow of liquid from the associated container 14.

Figure 6:
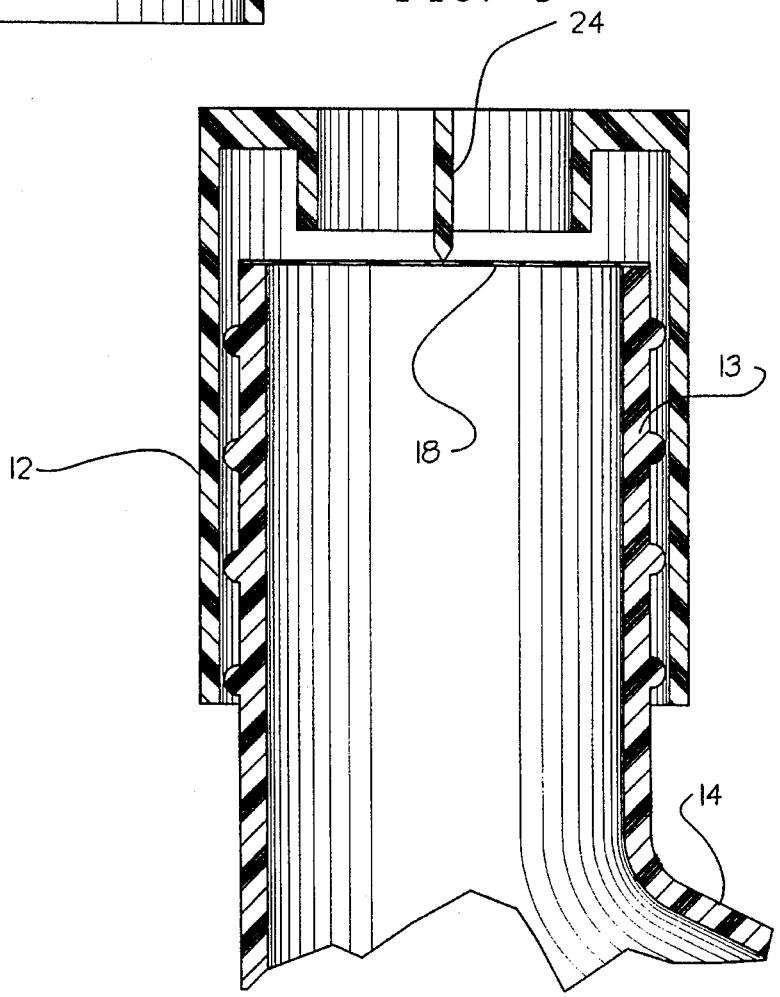
FIG. 6 is a cross sectional view of the invention in use.
Figure 7:
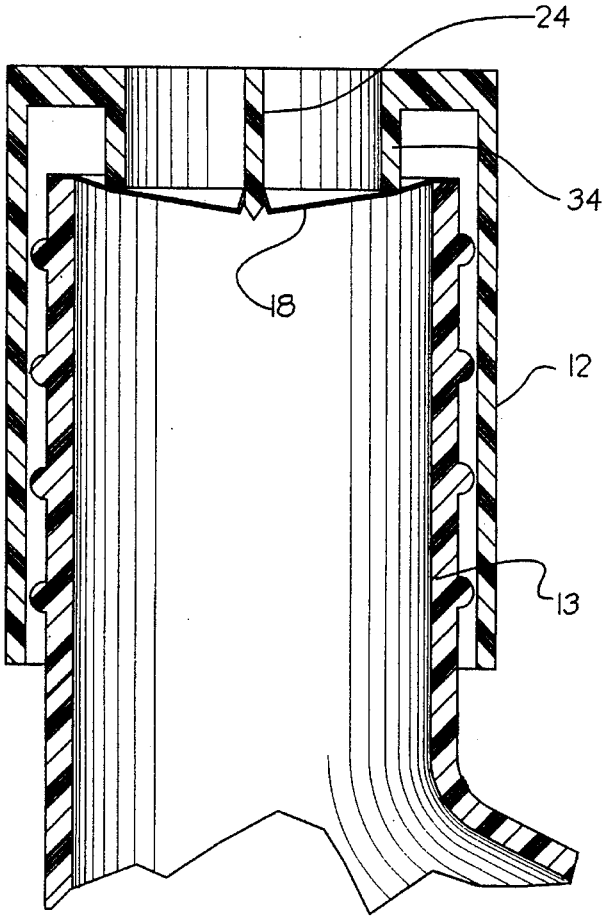
FIG. 7 is a further cross sectional view of the invention in use.
Figure 8:
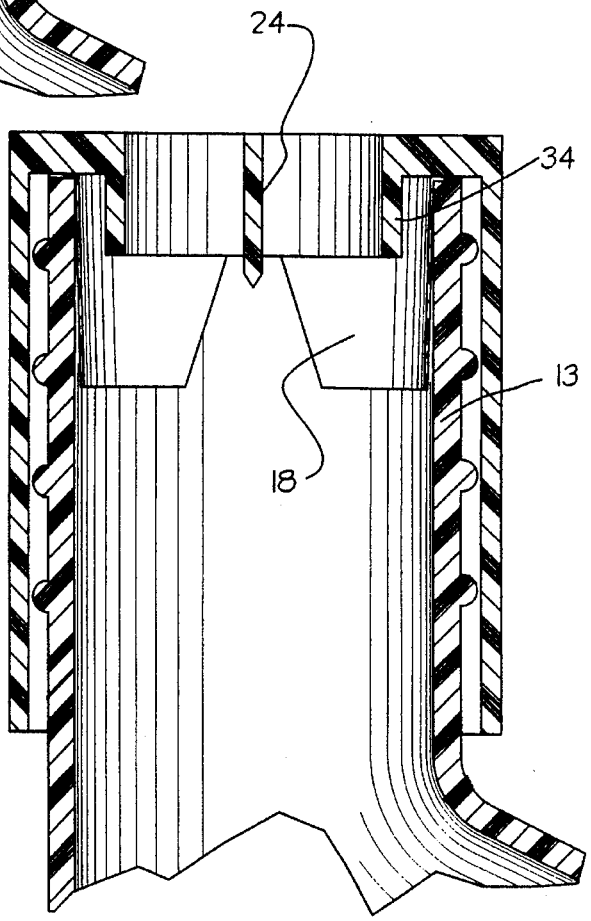
FIG. 8 is a yet further cross sectional view of the invention in use.

Turning now to FIGS. 6 through 8 wherein a use of the device 10 is illustrated, it can be shown that during initial advancing of the neck 13 of the container 14 into the cylindrical main body 12, the piercing blade 24 engages the frangible seal 18 to effect creation of a diametrically extending fracture. As the neck 13 is further advanced into the cylindrical main body 12, the depending cylindrical flange 34 of the clearing means 20 engages the frangible seal 18 to force the same into contact with an interior surface of the neck 13. This placement of the frangible seal 18 against an interior of the neck 13 permits liquids within the container 14 to quickly egress therefrom.

In use, the foil piercing and clearing nozzle according to the present invention can be easily utilized to facilitate automatic and expedited filling of oil or other fluids from a container into an engine or other apparatus.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A foil piercing and clearing nozzle comprising:

a cylindrical main body means for positioning over a neck of a container;

a piercing means mounted within the cylindrical main body means for piercing a frangible seal extending across an end of the neck of the container;

and, a clearing means mounted within the cylindrical main body means for engaging and positioning the frangible seal into an abutting relationship with an interior surface of the neck of the container so as to clear the frangible seal from a path of fluid exiting from the container;

wherein the piercing means comprises a piercing blade coupled to diametrically opposed interior surfaces of the clearing means, and wherein the clearing means comprises an annular wall fixedly surrounding the piercing means, said annular wall being fixedly located between said cylindrical main body means and terminating in a downwardly depending edge for engaging said foil along a concentric path of constant radial distance between said piercing means and said cylindrical main body means.

2. The foil piercing and clearing nozzle of claim 1, wherein the clearing means annular wall comprises an annular top wall coupled to an end of the cylindrical main body means and extending radially inwardly therefrom to terminate in an inner circumferential edge; and a depending cylindrical flange extending substantially orthogonally from the inner circumferential edge of the annular top wall so as to be positioned in a substantially spaced, parallel, and concentric orientation relative to an interior wall of the cylindrical main body means, the depending cylindrical flange cooperating with the interior wall of the cylindrical main body means to define an annular groove within which an end of the neck across which the frangible seal of the container extends can be received.

3. The foil piercing and clearing nozzle of claim 1 wherein the piercing blade is substantially triangular in shape and includes a pair of angled blade edges extending at oblique angles relative to one another which cooperate to define a sharpened piercing tip, and wherein said downwardly depending edge of said clearing wall is located a fixed radial distance from said tip.

4. A foil piercing and clearing nozzle comprising a cylindrical main body means for positioning over a neck of a container;

a piercing means mounted within the cylindrical main body means for piercing a frangible seal extending across an end of the neck of the container;

and, a clearing means mounted within the cylindrical main body means for engaging and positioning the frangible seal into an abutting relationship with an interior surface of the neck of the container so as to clear the frangible seal from a path of fluid exiting from the container;

wherein the piercing means comprises a piercing blade coupled to diametrically opposed interior surfaces of the clearing means, and wherein the piercing blade is substantially triangular in shape and includes a pair of angled blade edges extending at oblique angles relative to one another which cooperate to defining a sharpened piercing tip, wherein the piercing blade further includes opposed mounting projections which engage cooperatively formed mounting apertures within the clearing means.

5. A method of opening a container having a neck with a frangible foil seal extending across the neck, said method comprising the steps of:

providing a foil piercing and clearing nozzle comprising:

a cylindrical main body means for positioning over a neck of a container;

a piercing means mounted within the cylindrical main body means for piercing a frangible seal extending across an end of the neck of the container;

and, a clearing means mounted within the cylindrical main body means for engaging and positioning the frangible seal into an abutting relationship with an interior surface of the neck of the container so as to clear the frangible seal from a path of fluid exiting from the container;

wherein the piercing means comprises a piercing blade coupled to diametrically opposed interior surfaces of the clearing means, and wherein the clearing means comprises an annular wall fixedly surrounding the piercing means, said annular wall being fixedly located between said cylindrical main body means and terminating in a downwardly depending edge for engaging said foil along a concentric path of constant radial distance between said piercing means and said cylindrical main body means;

positioning the neck of the container into the cylindrical main body means;

inverting the container with the cylindrical main body means positioned over the neck thereof;

placing the cylindrical main body means over an oil fill hole of an apparatus and into contact with a portion of the apparatus;

and, advancing the neck of the container into the cylindrical main body means, whereby the piercing means engages the frangible seal to effect creation of a fracture, and the clearing means engages the frangible seal to force the frangible seal into contact with an interior surface of the neck.

* * * * *